US009865269B2

(12) United States Patent
Vasilache et al.

(10) Patent No.: US 9,865,269 B2
(45) Date of Patent: Jan. 9, 2018

(54) STEREO AUDIO SIGNAL ENCODER

(75) Inventors: Adriana Vasilache, Tampere (FI); Lasse Juhani Laaksonen, Nokia (FI); Anssi Sakari Rämö, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 14/414,972

(22) PCT Filed: Jul. 19, 2012

(86) PCT No.: PCT/IB2012/053690

§ 371 (c)(1),
(2), (4) Date: Apr. 20, 2015

(87) PCT Pub. No.: WO2014/013294

PCT Pub. Date: Jan. 23, 2014

(65) Prior Publication Data

US 2015/0310871 A1 Oct. 29, 2015

(51) Int. Cl.

| | |
|---|---|
| ***H04R 5/00*** | (2006.01) |
| ***G10L 19/008*** | (2013.01) |
| ***G10L 19/035*** | (2013.01) |

(52) U.S. Cl.

CPC ..... *G10L 19/008* (2013.01); *G10L 19/035* (2013.01)

(58) Field of Classification Search

CPC ..... G10L 19/008; G10L 19/035

See application file for complete search history.

(56) References Cited

U.S. PATENT DOCUMENTS

2002/0111804 A1 8/2002 Choy et al.
2002/0131506 A1 9/2002 Kerofsky et al.
2003/0118244 A1* 6/2003 Effros ..... H03M 7/30 382/251
2004/0181394 A1* 9/2004 Kim ..... G10L 19/24 704/200.1
2005/0226426 A1 10/2005 Oomen et al.
2007/0071247 A1 3/2007 Pang et al.
2008/0243519 A1 10/2008 Oh et al.
2009/0037186 A1* 2/2009 Liebchen ..... G10L 19/12 704/500
2009/0228284 A1 9/2009 Moon et al.

(Continued)

FOREIGN PATENT DOCUMENTS

CN 101379554 A 3/2009
WO 2013/179084 A1 12/2013

OTHER PUBLICATIONS

International Search Report and Written Opinion received for corresponding Patent Cooperation Treaty Application No. PCT/IB2012/053690, dated Jun. 25, 2013, 15 pages.

(Continued)

*Primary Examiner* — Simon King

(74) *Attorney, Agent, or Firm* — Alston & Bird LLP

(57) ABSTRACT

An apparatus comprising: a channel analyzer configured to determine at least one set of parameters defining a difference between at least two audio signal channels; a value analyzer configured to analyze the at least one set of parameters to determine an initial trend; a mapper configured to map instances of the at least one set of parameters according to a first mapping to generate mapped instances with associated order position instances based on the initial trend; and an encoder configured to encode the mapped instances based on the order position of the mapped instances.

20 Claims, 10 Drawing Sheets

(56) References Cited

U.S. PATENT DOCUMENTS

| | | | | |
|---|---|---|---|---|
| 2010/0174548 | A1 | 7/2010 | Seon et al. | |
| 2011/0200125 | A1* | 8/2011 | Multrus | H03M 7/3088 375/259 |
| 2013/0266078 | A1* | 10/2013 | Deligiannis | H04N 19/00533 375/240.25 |
| 2016/0027445 | A1* | 1/2016 | Vasilache | G10L 19/035 381/22 |

OTHER PUBLICATIONS

Engdegard et al. "MPEG Spatial Audio Object Codinga the ISO/MPEG Standard for Efficient Coding of Interactive Audio Scenes", AES Convention 129; Nov. 2010.

Faller C. "Parameteric Coding of Spatial Audio", Proceedings of the International Conference on Digital Audioeffects, Oct. 5, 2004.

Extended European Search Report received for corresponding European Patent Application No. 12881436.5, dated Mar. 11, 2016, 10 pages.

Office action received for corresponding Chinese Patent Application No. 201280075873.8, dated Nov. 2, 2016, 12 pages of office action and no pages of office action translation available.

* cited by examiner

STEREO AUDIO SIGNAL ENCODER

RELATED APPLICATION

This application was originally filed as PCT Application No. PCT/IB2012/053690 filed Jul. 19, 2012.

FIELD

The present application relates to a stereo audio signal encoder, and in particular, but not exclusively to a stereo audio signal encoder for use in portable apparatus.

BACKGROUND

Audio signals, like speech or music, are encoded for example to enable efficient transmission or storage of the audio signals.

Audio encoders and decoders (also known as codecs) are used to represent audio based signals, such as music and ambient sounds (which in speech coding terms can be called background noise). These types of coders typically do not utilise a speech model for the coding process, rather they use processes for representing all types of audio signals, including speech. Speech encoders and decoders (codecs) can be considered to be audio codecs which are optimised for speech signals, and can operate at either a fixed or variable bit rate.

An audio codec can also be configured to operate with varying bit rates. At lower bit rates, such an audio codec may be optimized to work with speech signals at a coding rate equivalent to a pure speech codec. At higher bit rates, the audio codec may code any signal including music, background noise and speech, with higher quality and performance. A variable-rate audio codec can also implement an embedded scalable coding structure and bitstream, where additional bits (a specific amount of bits is often referred to as a layer) improve the coding upon lower rates, and where the bitstream of a higher rate may be truncated to obtain the bitstream of a lower rate coding. Such an audio codec may utilize a codec designed purely for speech signals as the core layer or lowest bit rate coding.

An audio codec is designed to maintain a high (perceptual) quality while improving the compression ratio. Thus instead of waveform matching coding it is common to employ various parametric schemes to lower the bit rate. For multichannel audio, such as stereo signals, it is common to use a larger amount of the available bit rate on a mono channel representation and encode the stereo or multichannel information exploiting a parametric approach which uses relatively fewer bits.

SUMMARY

There is provided according to a first aspect a method comprising: determining at least one set of parameters defining a difference between at least two audio signal channels; analysing the at least one set of parameters to determine an initial trend; mapping instances of the at least one set of parameters according to a first mapping to generate mapped instances with associated order position instances based on the initial trend; and encoding the mapped instances based on the order position of the mapped instances.

The method may further comprise: determining at least one subsequent parameter; mapping the subsequent instances dependent on the frequency distribution of mapped instances and the first mapping to generate a remapped instance with an associated order position; and encoding the remapped instance based on an order position of the remapped instance.

The parameter may comprise at least one of: an interaural time difference; and an interaural level difference.

The method may further comprise scalar quantizing the instances of the parameter.

Analysing the at least one set of parameters to determine an initial trend may comprise determining at least one of: all of the at least one set of parameters have positive values; all of the at least one set of parameters have negative values; most of the at least one set of parameters have positive values; most of the at least one set of parameters have negative values; all of the at least one set of parameters have lower magnitude values; all of the at least one set of parameters have higher magnitude values; and all of the at least one set of parameters have range defined magnitude values.

Mapping instances of the at least one set of parameters according to a first mapping to generate mapped instances with associated order position instances based on the initial trend may comprise generating an initial mapping wherein the initial trend values are assigned a lower or earlier order.

The method may further comprise determining a frequency distribution for a group of first mapped instances.

Determining a frequency distribution for a group of first mapped instances may comprise: receiving for each of the group of first mapped instances the first mapped instance value; increasing a count value associated with the first mapped instance value; decreasing a count value associated with instance values other than the first mapped instance value.

Encoding the mapped instance dependent on an order position of the mapped instance may comprise applying a Golomb-Rice encoding to the mapped instance dependent on the mapped instance order position.

The method may further comprise: generating an indicator representing the first mapping; and multiplexing an encoded single channel representation, an encoded mapped instance and the indicator representing the first mapping to generate an encoded multichannel audio signal; and outputting the encoded multichannel audio signal.

According to a second aspect there is provided a method comprising: decoding from a first part of a signal a parameter instance and from a second part a parameter trend indicator; and mapping the parameter instance dependent on the parameter trend indicator to generate a demapped parameter instance, wherein the mapping is dependent on the parameter trend indicator.

The method may further comprise: decoding from the first part of a signal a further parameter instance; and mapping the further parameter instance dependent on the frequency distribution of the demapped parameter instances.

Decoding from a first part of a signal a parameter instance may comprise decoding a first part of a signal using a Golomb-Rice decoding.

The method may further comprise determining the frequency distribution of the parameter instances.

Determining the frequency distribution of the parameter instances may comprise maintaining a count of the demapped parameter instances for a group of the demapped parameter instances.

Mapping the parameter instances may comprise: determining an inverse mapping dependent on a decreasing occurrence order mapping for the frequency distribution of remapped parameter instances; and applying the inverse mapping.

According to a third aspect there is provided an apparatus comprising at least one processor and at least one memory including computer code for one or more programs, the at least one memory and the computer code configured to with the at least one processor cause the apparatus to at least perform: determining at least one set of parameters defining a difference between at least two audio signal channels; analysing the at least one set of parameters to determine an initial trend; mapping instances of the at least one set of parameters according to a first mapping to generate mapped instances with associated order position instances based on the initial trend; and encoding the mapped instances based on the order position of the mapped instances.

The apparatus may be further caused to perform: determining at least one subsequent parameter; mapping the subsequent instances dependent on the frequency distribution of mapped instances and the first mapping to generate a remapped instance with an associated order position; and encoding the remapped instance based on an order position of the remapped instance.

The apparatus may be further caused to perform scalar quantizing the instances of the parameter.

Analysing the at least one set of parameters to determine an initial trend may cause the apparatus to perform determining at least one of: all of the at least one set of parameters have positive values; all of the at least one set of parameters have negative values; most of the at least one set of parameters have positive values; most of the at least one set of parameters have negative values; all of the at least one set of parameters have lower magnitude values; all of the at least one set of parameters have higher magnitude values; and all of the at least one set of parameters have range defined magnitude values.

Mapping instances of the at least one set of parameters according to a first mapping to generate mapped instances with associated order position instances based on the initial trend may cause the apparatus to perform generating an initial mapping wherein the initial trend values are assigned a lower or earlier order.

The apparatus may further be caused to perform determining a frequency distribution for a group of first mapped instances.

Determining a frequency distribution for a group of first mapped instances may cause the apparatus to perform: receiving for each of the group of first mapped instances the first mapped instance value; increasing a count value associated with the first mapped instance value; and decreasing a count value associated with instance values other than the first mapped instance value.

Encoding the mapped instance dependent on an order position of the mapped instance may cause the apparatus to perform applying a Golomb-Rice encoding to the mapped instance dependent on the mapped instance order position.

The apparatus may further comprise: generating an indicator representing the first mapping; and multiplexing an encoded single channel representation, an encoded mapped instance and the indicator representing the first mapping to generate an encoded multichannel audio signal; and outputting the encoded multichannel audio signal.

According to a fourth aspect there is provided an apparatus comprising at least one processor and at least one memory including computer code for one or more programs, the at least one memory and the computer code configured to with the at least one processor cause the apparatus to at least perform: decoding from a first part of a signal a parameter instance and from a second part a parameter trend indicator; and mapping the parameter instance dependent on the parameter trend indicator to generate a demapped parameter instance, wherein the mapping is dependent on the parameter trend indicator.

The apparatus may be further caused to perform: decoding from the first part of a signal a further parameter instance; and mapping the further parameter instance dependent on the frequency distribution of the demapped parameter instances.

Decoding from a first part of a signal a parameter instance may comprise decoding a first part of a signal using a Golomb-Rice decoding.

The apparatus may be caused to perform determining the frequency distribution of the parameter instances.

Determining the frequency distribution of the parameter instances may cause the apparatus to perform maintaining a count of the demapped parameter instances for a group of the demapped parameter instances.

Mapping the parameter instances may cause the apparatus to perform: determining an inverse mapping dependent on a decreasing occurrence order mapping for the frequency distribution of remapped parameter instances; and applying the inverse mapping.

According to a fifth aspect there is provided an apparatus comprising: means for determining at least one set of parameters defining a difference between at least two audio signal channels; means for analysing the at least one set of parameters to determine an initial trend; means for mapping instances of the at least one set of parameters according to a first mapping to generate mapped instances with associated order position instances based on the initial trend; and means for encoding the mapped instances based on the order position of the mapped instances.

The apparatus may further comprise: means for determining at least one subsequent parameter; means for mapping the subsequent instances dependent on the frequency distribution of mapped instances and the first mapping to generate a remapped instance with an associated order position; and means for encoding the remapped instance based on an order position of the remapped instance.

The apparatus may comprise means for scalar quantizing the instances of the parameter.

The means for analysing the at least one set of parameters to determine an initial trend may comprise means for determining at least one of: all of the at least one set of parameters have positive values; all of the at least one set of parameters have negative values; most of the at least one set of parameters have positive values; most of the at least one set of parameters have negative values; all of the at least one set of parameters have lower magnitude values; all of the at least one set of parameters have higher magnitude values; and all of the at least one set of parameters have range defined magnitude values.

The means for mapping instances of the at least one set of parameters according to a first mapping to generate mapped instances with associated order position instances based on the initial trend may comprise means for generating an initial mapping wherein the initial trend values are assigned a lower or earlier order.

The apparatus may comprise means for determining a frequency distribution for a group of first mapped instances.

The means for determining a frequency distribution for a group of first mapped instances may comprise: means for receiving for each of the group of first mapped instances the first mapped instance value; means for increasing a count value associated with the first mapped instance value; and means for decreasing a count value associated with instance values other than the first mapped instance value.

The means for encoding the mapped instance dependent on an order position of the mapped instance may comprise means for applying a Golomb-Rice encoding to the mapped instance dependent on the mapped instance order position.

The apparatus may further comprise: means for generating an indicator representing the first mapping; and means for multiplexing an encoded single channel representation, an encoded mapped instance and the indicator representing the first mapping to generate an encoded multichannel audio signal; and means for outputting the encoded multichannel audio signal.

According to a sixth aspect there is provided an apparatus comprising: means for decoding from a first part of a signal a parameter instance and from a second part a parameter trend indicator; and means for mapping the parameter instance dependent on the parameter trend indicator to generate a demapped parameter instance, wherein the mapping is dependent on the parameter trend indicator.

The apparatus may further comprise: means for decoding from the first part of a signal a further parameter instance; and means for mapping the further parameter instance dependent on the frequency distribution of the demapped parameter instances.

The means for decoding from a first part of a signal a parameter instance may comprise means for decoding a first part of a signal using a Golomb-Rice decoding.

The apparatus may comprise means for determining the frequency distribution of the parameter instances.

The means for determining the frequency distribution of the parameter instances may comprise means for maintaining a count of the demapped parameter instances for a group of the demapped parameter instances.

The means for mapping the parameter instances may comprise: means for determining an inverse mapping dependent on a decreasing occurrence order mapping for the frequency distribution of remapped parameter instances; and means for applying the inverse mapping.

According to a seventh aspect there is provided an apparatus comprising: a channel analyser configured to determine at least one set of parameters defining a difference between at least two audio signal channels; a value analyser configured to analyse the at least one set of parameters to determine an initial trend; a mapper configured to map instances of the at least one set of parameters according to a first mapping to generate mapped instances with associated order position instances based on the initial trend; and an encoder configured to encode the mapped instances based on the order position of the mapped instances.

The channel analyser may be further configured to determine at least one subsequent parameter; the mapper may be further configured to map the subsequent instances dependent on the frequency distribution of mapped instances and the first mapping to generate a remapped instance with an associated order position; and the encoder may be further configured to encode the remapped instance based on an order position of the remapped instance.

The apparatus may comprise a scalar quantizer configured to scalar quantize the instances of the parameter.

The value analyser may be configured to determine at least one of: all of the at least one set of parameters have positive values; all of the at least one set of parameters have negative values; most of the at least one set of parameters have positive values; most of the at least one set of parameters have negative values; all of the at least one set of parameters have lower magnitude values; all of the at least one set of parameters have higher magnitude values; and all of the at least one set of parameters have range defined magnitude values.

The mapper may comprise a mapping initializer configured to generate an initial mapping wherein the initial trend values are assigned a lower or earlier order.

The apparatus may comprise a counter configured to determine a frequency distribution for a group of first mapped instances.

The counter may comprise: an input configured to receive for each of the group of first mapped instances the first mapped instance value; an incrementer configured to increase a count value associated with the first mapped instance value; and a decrementer configured to decrease a count value associated with instance values other than the first mapped instance value.

The encoder may comprise a Golomb-Rice encoder configured to apply a Golomb-Rice encoding to the mapped instance dependent on the mapped instance order position.

The apparatus may further comprise: an initial map indicator configured to generate an indicator representing the first mapping; and a multiplexer configured to multiplex an encoded single channel representation, an encoded mapped instance and the indicator representing the first mapping to generate an encoded multichannel audio signal; and an output configured to output the encoded multichannel audio signal.

According to an eighth aspect there is provided an apparatus comprising: a decoder configured to decode from a first part of a signal a parameter instance and from a second part a parameter trend indicator; and a mapper configured to map the parameter instance dependent on the parameter trend indicator to generate a demapped parameter instance, wherein the mapping is dependent on the parameter trend indicator.

The decoder may be further configured to decode from the first part of a signal a further parameter instance; and the mapper is further configured to map the further parameter instance dependent on the frequency distribution of the demapped parameter instances.

The decoder may comprise a Golomb-Rice decoder.

The apparatus may comprise a symbol count updater configured to determine a frequency distribution of the parameter instances.

The symbol count updater may be configured to maintain a count of the demapped parameter instances for a group of the demapped parameter instances.

The mapper may comprise: an inverse mapping determiner configured to determine an inverse mapping dependent on a decreasing occurrence order mapping for the frequency distribution of remapped parameter instances; and an inverse mapping processor configured to apply the inverse mapping.

The parameter may comprise at least one of: an interaural time difference; and an interaural level difference.

A computer program product may cause an apparatus to perform the method as described herein.

An electronic device may comprise apparatus as described herein.

A chipset may comprise apparatus as described herein.

BRIEF DESCRIPTION OF DRAWINGS

For better understanding of the present invention, reference will now be made by way of example to the accompanying drawings in which.

DESCRIPTION OF SOME EMBODIMENTS OF THE APPLICATION

Figure 1:
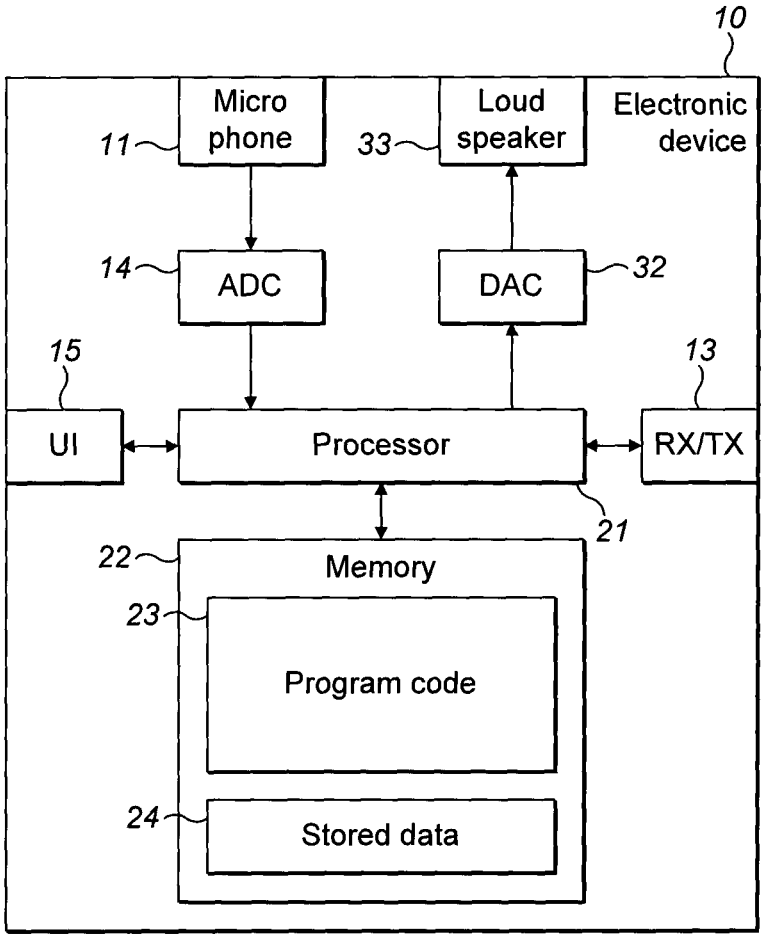
FIG. 1 shows schematically an electronic device employing some embodiments.

The following describes in more detail possible stereo and multichannel speech and audio codecs, including layered or scalable variable rate speech and audio codecs. In this regard reference is first made to FIG. 1 which shows a schematic block diagram of an exemplary electronic device or apparatus 10, which may incorporate a codec according to an embodiment of the application.

The apparatus 10 may for example be a mobile terminal or user equipment of a wireless communication system. In other embodiments the apparatus 10 may be an audio-video device such as video camera, a Television (TV) receiver, audio recorder or audio player such as a mp3 recorder/player, a media recorder (also known as a mp4 recorder/player), or any computer suitable for the processing of audio signals.

The electronic device or apparatus 10 in some embodiments comprises a microphone 11, which is linked via an analogue-to-digital converter (ADC) 14 to a processor 21. The processor 21 is further linked via a digital-to-analogue (DAC) converter 32 to loudspeakers 33. The processor 21 is further linked to a transceiver (RX/TX) 13, to a user interface (UI) 15 and to a memory 22.

The processor 21 can in some embodiments be configured to execute various program codes. The implemented program codes in some embodiments comprise a multichannel or stereo encoding or decoding code as described herein. The implemented program codes 23 can in some embodiments be stored for example in the memory 22 for retrieval by the processor 21 whenever needed. The memory 22 could further provide a section 24 for storing data, for example data that has been encoded in accordance with the application.

The encoding and decoding code in embodiments can be implemented in hardware and/or firmware.

The user interface 15 enables a user to input commands to the electronic device 10, for example via a keypad, and/or to obtain information from the electronic device 10, for example via a display. In some embodiments a touch screen may provide both input and output functions for the user interface. The apparatus 10 in some embodiments comprises a transceiver 13 suitable for enabling communication with other apparatus, for example via a wireless communication network.

It is to be understood again that the structure of the apparatus 10 could be supplemented and varied in many ways.

A user of the apparatus 10 for example can use the microphone 11 for inputting speech or other audio signals that are to be transmitted to some other apparatus or that are to be stored in the data section 24 of the memory 22. A corresponding application in some embodiments can be activated to this end by the user via the user interface 15. This application in these embodiments can be performed by the processor 21, causes the processor 21 to execute the encoding code stored in the memory 22.

The analogue-to-digital converter (ADC) 14 in some embodiments converts the input analogue audio signal into a digital audio signal and provides the digital audio signal to the processor 21. In some embodiments the microphone 11 can comprise an integrated microphone and ADC function and provide digital audio signals directly to the processor for processing.

Figure 8:
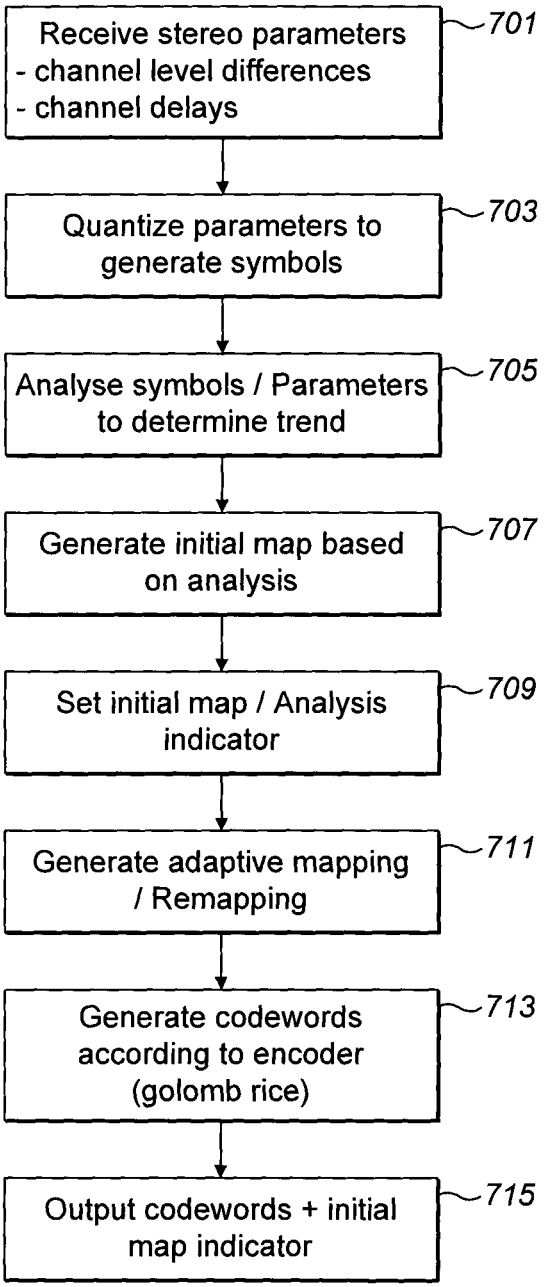
FIG. 8 shows a flow diagram illustrating the operation of the channel encoder as shown in FIG. 5 according to some embodiments.
Figure 9:
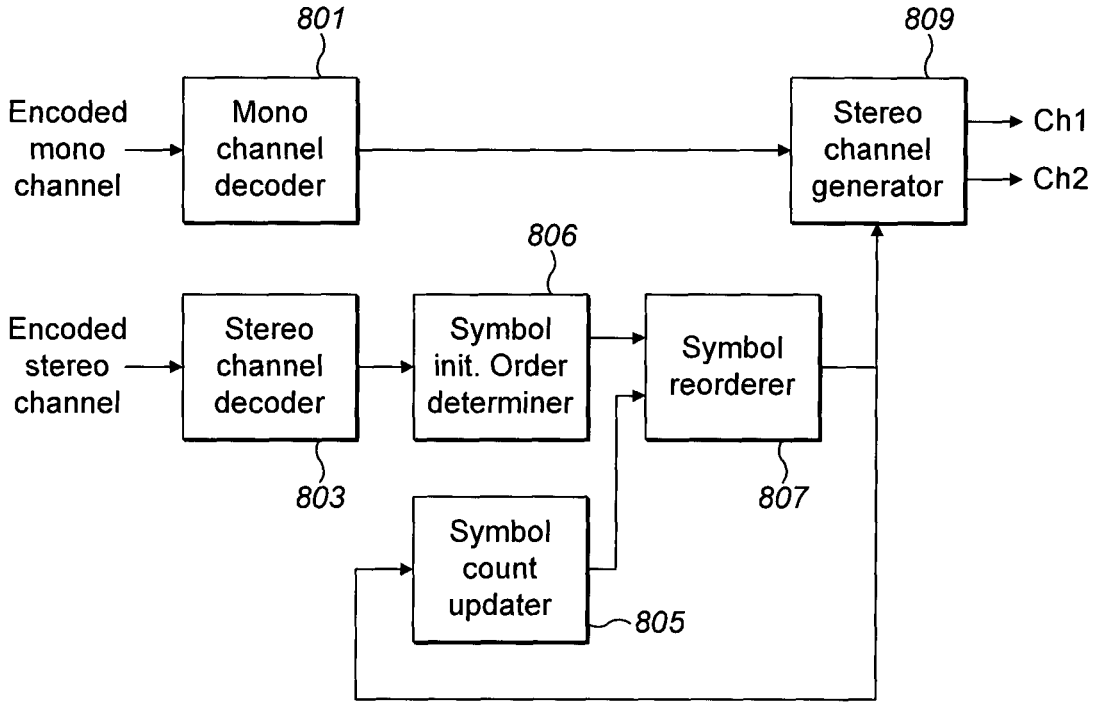
FIG. 9 shows schematically the decoder as shown in FIG. 2 according to some embodiments.
Figure 10:
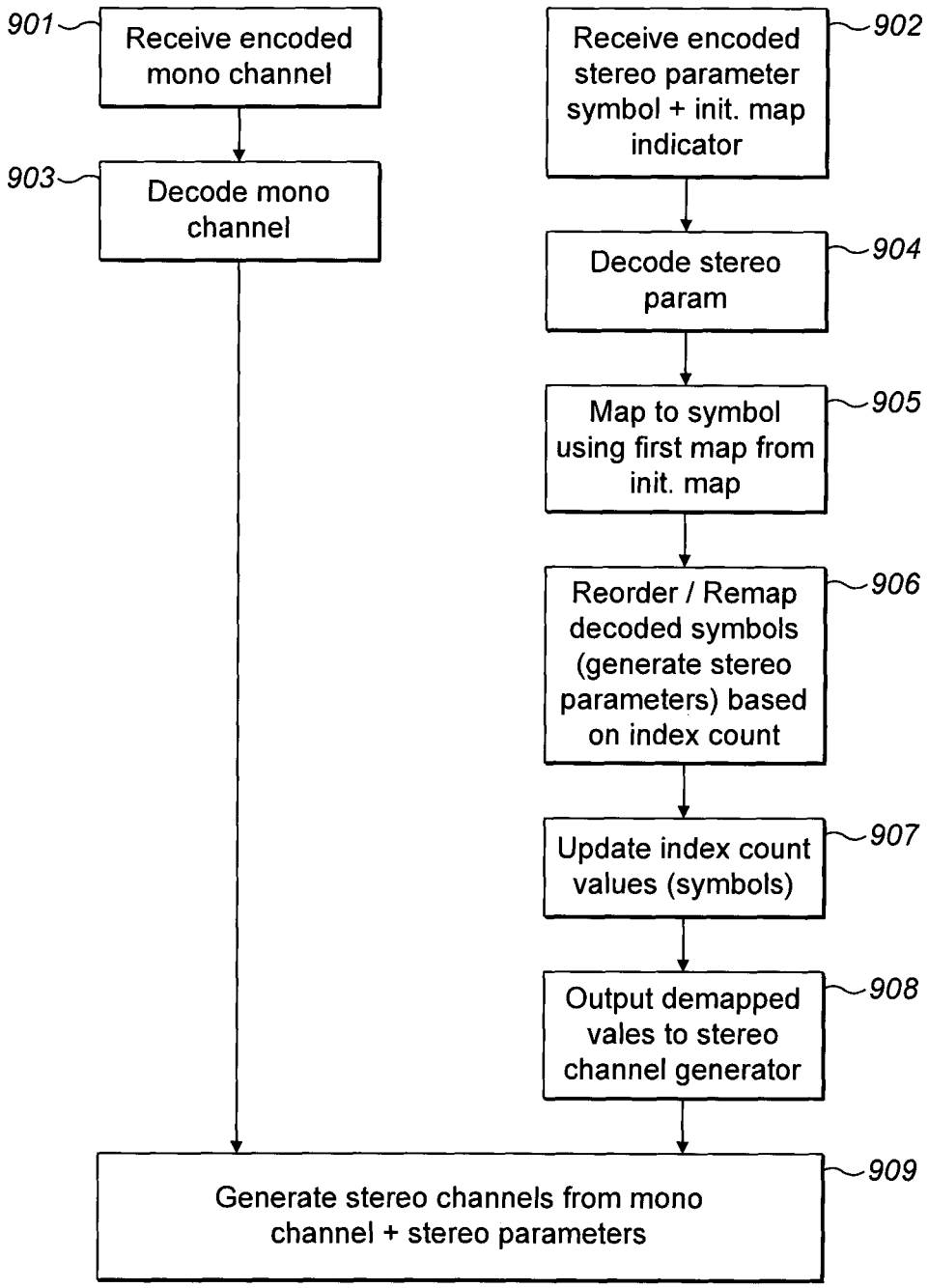
FIG. 10 shows a flow diagram illustrating the operation of the decoder as shown in FIG. 9 according to some embodiments.

The processor 21 in such embodiments then processes the digital audio signal in the same way as described with reference to the system shown in FIG. 2, the encoder shown in FIGS. 2 to 8 and the decoder as shown in FIGS. 9 and 10.

The resulting bit stream can in some embodiments be provided to the transceiver 13 for transmission to another apparatus. Alternatively, the coded audio data in some embodiments can be stored in the data section 24 of the memory 22, for instance for a later transmission or for a later presentation by the same apparatus 10.

The apparatus 10 in some embodiments can also receive a bit stream with correspondingly encoded data from another apparatus via the transceiver 13. In this example, the processor 21 may execute the decoding program code stored in the memory 22. The processor 21 in such embodiments decodes the received data, and provides the decoded data to a digital-to-analogue converter 32. The digital-to-analogue converter 32 converts the digital decoded data into analogue audio data and can in some embodiments output the analogue audio via the loudspeakers 33. Execution of the decoding program code in some embodiments can be triggered as well by an application called by the user via the user interface 15.

The received encoded data in some embodiment can also be stored instead of an immediate presentation via the loudspeakers 33 in the data section 24 of the memory 22, for instance for later decoding and presentation or decoding and forwarding to still another apparatus.

It would be appreciated that the schematic structures described in FIGS. 3 to 5 and 9, and the method steps shown in FIGS. 6 to 8 and 10 represent only a part of the operation of an audio codec and specifically part of a stereo encoder/decoder apparatus or method as exemplarily shown implemented in the apparatus shown in FIG. 1.

Figure 2:
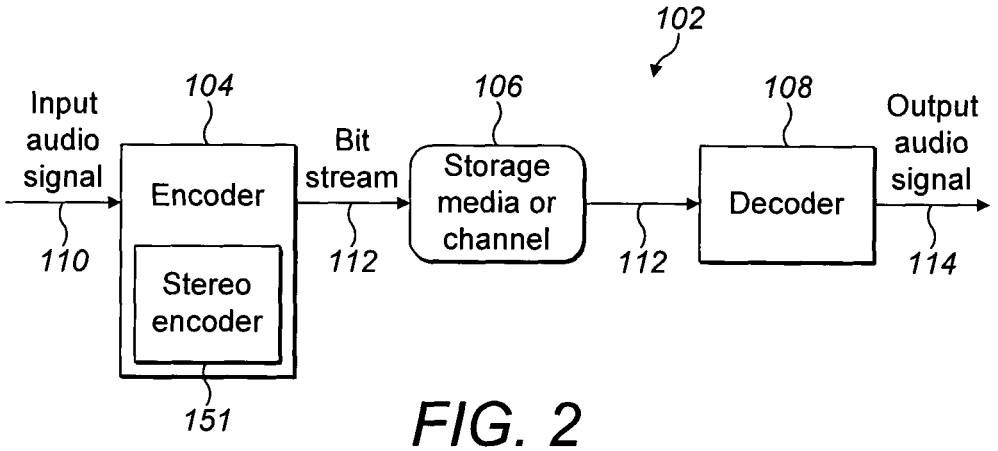
FIG. 2 shows schematically an audio codec system according to some embodiments.

The general operation of audio codecs as employed by embodiments is shown in FIG. 2. General audio coding/decoding systems comprise both an encoder and a decoder, as illustrated schematically in FIG. 2. However, it would be understood that some embodiments can implement one of either the encoder or decoder, or both the encoder and decoder. Illustrated by FIG. 2 is a system 102 with an encoder 104 and in particular a stereo encoder 151, a storage or media channel 106 and a decoder 108. It would be understood that as described above some embodiments can comprise or implement one of the encoder 104 or decoder 108 or both the encoder 104 and decoder 108.

The encoder 104 compresses an input audio signal 110 producing a bit stream 112, which in some embodiments can be stored or transmitted through a media channel 106. The encoder 104 furthermore can comprise a stereo encoder 151 as part of the overall encoding operation. It is to be understood that the stereo encoder may be part of the overall encoder 104 or a separate encoding module. The encoder 104 can also comprise a multi-channel encoder that encodes more than two audio signals.

The bit stream 112 can be received within the decoder 108. The decoder 108 decompresses the bit stream 112 and produces an output audio signal 114. The decoder 108 can comprise a stereo decoder as part of the overall decoding operation. It is to be understood that the stereo decoder may be part of the overall decoder 108 or a separate decoding module. The decoder 108 can also comprise a multi-channel decoder that decodes more than two audio signals. The bit rate of the bit stream 112 and the quality of the output audio signal 114 in relation to the input signal 110 are the main features which define the performance of the coding system 102.

Figure 3:
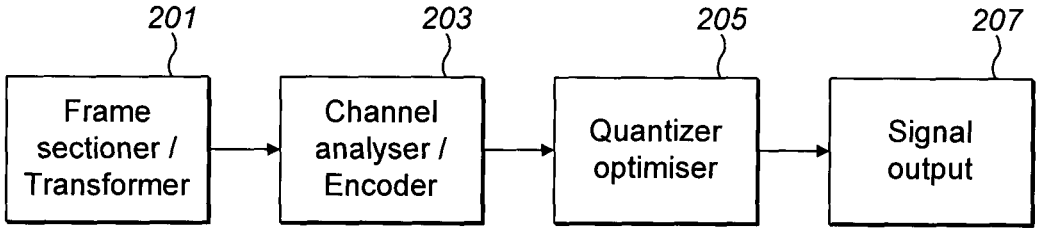
FIG. 3 shows schematically an encoder as shown in FIG. 2 according to some embodiments.

FIG. 3 shows schematically the encoder 104 according to some embodiments.

Figure 6:
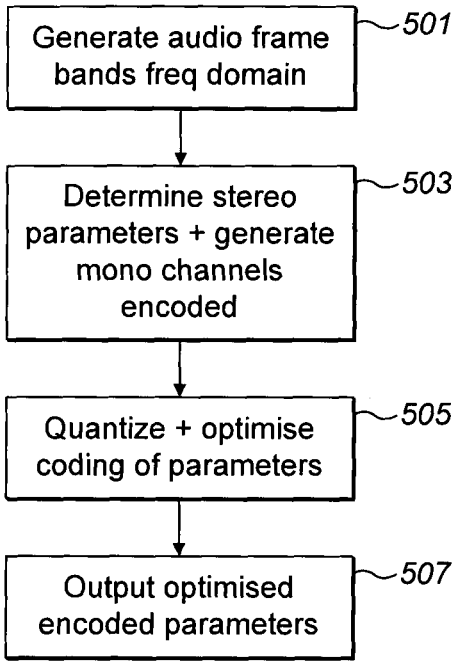
FIG. 6 shows a flow diagram illustrating the operation of the encoder shown in FIG. 2 according to some embodiments.

FIG. 6 shows schematically in a flow diagram the operation of the encoder 104 according to some embodiments.

The concept for the embodiments as described herein is to attempt to form a stereo or multichannel coding to produce efficient high quality and low bit rate stereo or multichannel signal coding. The use of Golomb-Rice coding within an integer encoder is able to produce a very low complexity encoder suitable for providing good compression efficiency where data is exponentially distributed. Golomb-Rice codes or entropy encoding for example can be used where the number of coding symbols is not known or fixed. Furthermore Golomb-Rice or entropy encoding of integers can be performed on the quantisation codevector indices to reduce the bit rate.

It would be understood that encoding indices of quantised sub-band level differences in binaural representations of stereo audio signals produce values where the probability distribution changes dramatically one frame to another.

An entropy encoder configured to encode average values of the data would therefore produce sub-optimal results. Although an adaptive Golomb-Rice coding can produce a greater efficiency they can have slow response times where the adaptive nature of the coding tracks the quantised output.

Thus in the embodiments a low complexity adaptive entropy coding is described herein using a Golomb-Rice coding scheme to produce a low bit rate and low complexity encoder but by employing an initial analysis of the information or by using knowledge of an expected distribution of the quantized difference and delay values an initial coding mapping can be defined which can reduce the tracking delay between the initialisation of the coding and the coding approximating an optimal mapping. For example where there is knowledge from the start that only a sub-set of the set of symbols are encountered the adaptation efficiency or optimization tracking can be improved where this extra information is used. Thus the concept as described herein is to detect the cases when the sub-set of symbols is used (there are less distinct symbols used) for the current frame and signal which symbols are used. The concept furthermore describes where a small number of such cases are considered, otherwise the information on which symbols are used would quickly fill in the available bitrate. The concept as furthermore described herein further proposes defining and detection of these cases, and their corresponding coding procedure.

The concept for the embodiments as described herein is to determine and apply a stereo coding mode to produce efficient high quality and low bit rate real life stereo signal coding. To that respect with respect to FIG. 3 an example encoder 104 is shown according to some embodiments. Furthermore with respect to FIG. 6 the operation of the encoder 104 is shown in further detail.

The encoder 104 in some embodiments comprises a frame sectioner/transformer 201. The frame sectioner/transformer 201 is configured to receive the left and right (or more generally any multichannel audio representation) input audio signals and generate frequency domain representations of these audio signals to be analysed and encoded. These frequency domain representations can be passed to the channel parameter determiner 203.

In some embodiments the frame sectioner/transformer can be configured to section or segment the audio signal data into sections or frames suitable for frequency domain transformation. The frame sectioner/transformer 201 in some embodiments can further be configured to window these frames or sections of audio signal data according to any suitable windowing function. For example the frame sectioner/transformer 201 can be configured to generate frames of 20 ms which overlap preceding and succeeding frames by 10 ms each.

In some embodiments the frame sectioner/transformer can be configured to perform any suitable time to frequency domain transformation on the audio signal data. For example the time to frequency domain transformation can be a discrete Fourier transform (DFT), Fast Fourier transform (FFT), modified discrete cosine transform (MDCT). In the following examples a Fast Fourier Transform (FFT) is used. Furthermore the output of the time to frequency domain transformer can be further processed to generate separate frequency band domain representations (sub-band representations) of each input channel audio signal data. These bands can be arranged in any suitable manner. For example these bands can be linearly spaced, or be perceptual or psychoacoustically allocated.

In some embodiments there can be differing sets of sub-bands dependent on the bandwidth used to encode the data. For example there can in some embodiments be a wideband (WB), superwideband (SWB), and fullband (FB) bandwidth coding implementation where the SWB implementation uses more bits than the WB implementation and the FB more than the SWB implementation. In some embodiments there can be different sub-bands for different channel difference (as described herein) uses. For example for each of the three considered bandwidths: wideband (WB), superwideband (SWB), and fullband (FB), there can be a particular division in subbands, as described below which have slightly different for delays and levels differences (levels).

```
/* subband division for delays */
const short scale1024_WB[ ] =
{          1, 5, 8, 12, 20, 34, 48, 56, 120, 512};
const short scale1024_SWB[ ] =
{          1, 2, 4, 6, 10, 14, 17, 24, 28, 60, 256, 512};
const short scale1024_FB[ ] =
{          1, 2, 3, 4, 7, 11, 16, 19, 40, 171, 341, 448 /* ~21 kHz */};
/* subband division for level differences */
const short scf_band_WB[ ] =
{  1, 8, 20, 32, 44, 60, 90, 110, 170, 216, 290, 394, 512};
const short scf_band_SWB[ ] =
{  1, 4, 10, 16, 22, 30, 45, 65, 85, 108, 145, 197, 256, 322, 412, 512};
const short scf_band_FB[ ] =
{  1, 3, 7, 11, 15, 20, 30, 43, 57, 72, 97, 131, 171, 215, 275, 341, 391,
448 /* ~21 kHz */};
```

The operation of generating audio frame band frequency domain representations is shown in FIG. 6 by step 501.

In some embodiments the frequency domain representations are passed to a channel analyser/encoder 203.

In some embodiments the encoder 104 can comprise a channel analyser/encoder 203. The channel analyser/encoder 203 can be configured to receive the sub-band filtered representations of the multichannel or stereo input. The channel analyser/encoder 203 can furthermore in some embodiments be configured to analyse the frequency domain audio signals and determine parameters associated with each sub-band with respect to the stereo or multichannel audio signal differences. Furthermore the channel analyser/encoder can use these parameters and generate a mono channel which can be encoded according to any suitable encoding.

In other words the parameters in some embodiments comprise a delay which is estimated between each pair of "delay" sub-bands. Furthermore in some embodiments following the finding of the delay, the two channels can be aligned and the level differences are calculated on the aligned channels. In some embodiments from the two aligned channels, a mono signal can be formed and encoded with a mono core encoder. The binaural parameters furthermore in some embodiments can be encoded and form the binaural extension of the codec. In some embodiments there can be two consecutive windows in the FFT domain for which the binaural parameters are estimated for each frame. In some embodiments only the first 7 delay values are encoded, so in total 14 delay values to be encoded per frame.

The stereo parameters and the mono encoded signal can be passed to the quantizer optimiser 205.

The operation of determining the stereo parameters and generating the mono channel and encoding the mono channel is shown in FIG. 6 by step 503.

Figure 4:
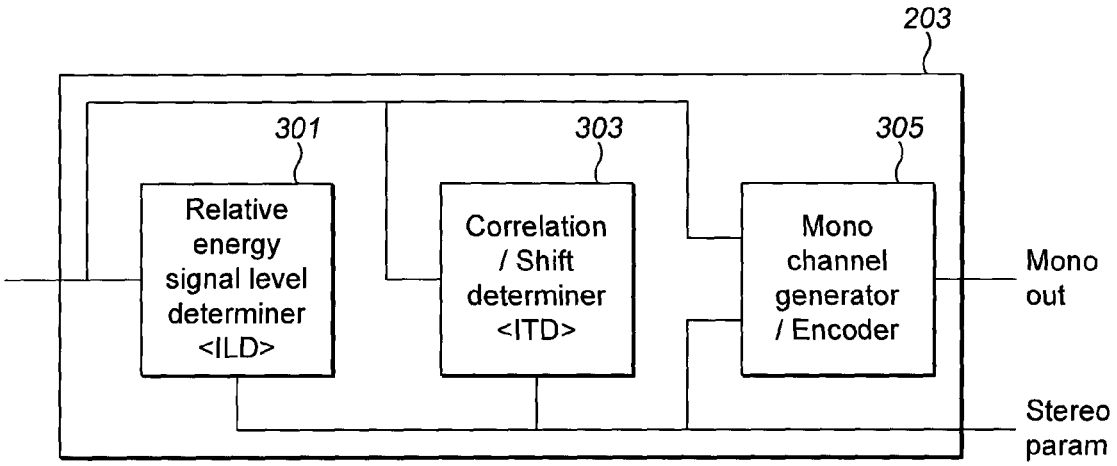
FIG. 4 shows schematically a channel analyser as shown in FIG. 3 in further detail according to some embodiments.

With respect to FIG. 4 an example channel analyser/encoder 203 according to some embodiments is described in further detail. Furthermore with respect to FIG. 7 the operation of the channel analyser/encoder 203 as shown in FIG. 4 is shown according to some embodiments.

In some embodiments the channel analyser 203 comprises a correlation/shift determiner 301. The correlation/shift determiner 301 is configured to determine the correlation or shift per sub-band between the two channels (or parts of multi-channel audio signals). The shifts (or the best correlation indices COR_IND[j]) can be determined for example using the following code.

```
for ( j = 0; NUM_OF_BANDS_FOR_COR_SEARCH; j++ )
{
    cor = COR_INIT;
    for ( n = 0; n < 2*MAXSHIFT + 1; n++ )
```

-continued

```
    {
        mag[n] = 0.0f;
        for (k = COR_BAND_START[j]; k <
        COR_BAND_START[j+1]; k++ )
        {
            mag[n] += svec_re[k] * cos( −2*PI*((n−MAXSHIFT) *
            k/L_FFT );
            mag[n] −= svec_im[k] * sin( −2*PI*((n−MAXSHIFT) *
            k/L_FFT );
        }
        if (mag[n] > cor)
        {
            cor_ind[j] = n − MAXSHIFT;
            cor = mag[n];
        }
    }
}
```

Where the value MAXSHIFT is the largest allowed shift (the value can be based on a model of the supported microphone arrangements or more simply the distance between the microphones) PI is π, COR_INIT is the initial correlation value or a large negative value to initialise the correlation calculation, and COR_BAND_START [ ] defines the starting points of the sub-bands. The vectors svec_re [ ] and svec_im [ ], the real and imaginary values for the vector, used herein are defined as follows:

```
svec_re[0] = fft_l[0] * fft_r[0];
svec_im[0] = 0.0f;
for (k = 1; k <
COR_BAND_START[NUM_OF_BANDS_FOR_COR_SEARCH];
k++)
{
    svec_re[k] = (fft_l[k] * fft_r[k])−(fft_l[L_FFT−k] *
    (−fft_r[L_FFT−k]));
    svec_im[k] = (fft_l[L_FFT−k] * fft_r[k]) + (fft_l[k] *
    (−fft_r[L_FFT−k]));
}
```

Figure 7:
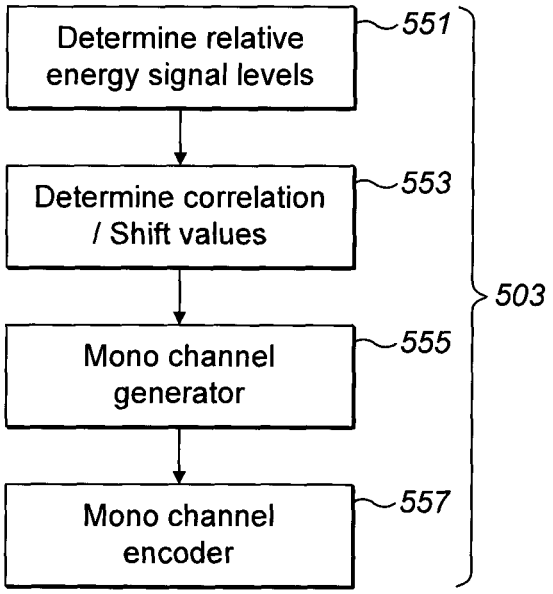
FIG. 7 shows a flow diagram illustrating the operation of the channel analyser as shown in FIG. 4 according to some embodiments.

The operation of determining the correlation/shift values is shown in FIG. 7 by step 551.

The correlation/shift values can in some embodiments be passed to the mono channel generator/encoder and as stereo channel parameters to the quantizer optimiser.

Furthermore in some embodiments the correlation/shift value is applied to one of the audio channels to provide a temporal alignment between the channels. These aligned channel audio signals can in some embodiments be passed to a relative energy signal level determiner 301.

The operation of aligning the channels using the correlation/shift value is shown in FIG. 7 by step 552.

In some embodiments the channel analyser/encoder 203 comprises a relative energy signal level determiner 301. The relative energy signal level determiner 301 is configured to receive the output aligned frequency domain representations and determine the relative signal levels between pairs of channels for each sub-band. It would be understood that in the following examples a single pair of channels are analysed and processed however this can be extended to any number of channels by a suitable pairing of the multichannel system.

In some embodiments the relative level for each band can be computing using the following code.

```
For (j = 0; j < NUM_OF_BANDS_FOR_SIGNAL_LEVELS; j++)
    {
        mag_l = 0.0;
        mag_r = 0.0;
        for (k = BAND_START[j]; k < BAND_START[j+1]; k++)
        {
            mag_l += fft_l[k]*fft_l[k] +
            fft_l[L_FFT-k]*fft_l[L_FFT-k];
            mag_r += fft_r[k]*fft_r[k] +
            fft_r[L_FFT-k]*fft_r[L_FFT-k];
        }
        mag[j] =
        10.0f*log10(sqrt((mag_l+EPSILON)/(mag_r+EPSILON)));
    }
```

Where L_FFT is the length of the FFT and EPSILON is a small value above zero to prevent division by zero problems. The relative energy signal level determiner in such embodiments effectively generates magnitude determinations for each channel (L and R) over each sub-band and then divides one channel value by the other to generate a relative value. In some embodiments the relative energy signal level determiner 301 is configured to output the relative energy signal level to the encoding mode determiner 205.

The operation of determining the relative energy signal level is shown in FIG. 7 by step 551.

The relative energy signal level values can in some embodiments be passed to the mono channel generator/encoder and as stereo channel parameters to the quantizer optimiser.

In some embodiments any suitable inter level (energy) and inter temporal (correlation or delay) difference estimation can be performed. For example for each frame there can be two windows for which the delay and levels are estimated. Furthermore in some embodiments for each window the delays can estimated for each of the delay relevant sub bands.

In some embodiments the encoder 104 comprises a mono channel generator/encoder 305. The mono channel generator is configured to receive the channel analyser values such as the relative energy signal level from the relative energy signal level determiner 301 and the correlation/shift level from the correlation/shift determiner 303. Furthermore in some embodiments the mono channel generator/encoder 305 can be configured to further receive the input multichannel audio signals. The mono channel generator/encoder 305 can in some embodiments be configured to apply the delay and level differences to the multichannel audio signals to generate an 'aligned' channel which is representative of the audio signals. In other words the mono channel generator/encoder 305 can generate a mono channel signal which represents an aligned multichannel audio signal. For example in some embodiments where there is determined to be a left channel audio signal and a right channel audio signal one of the left or right channel audio signals are delayed with respect to the other according to the determined delay difference and then the delayed channel and other channel audio signals are averaged to generate a mono channel signal. However it would be understood that in some embodiments any suitable mono channel generating method can be implemented.

The operation of generating a mono channel signal from a multichannel signal is shown in FIG. 7 by step 555.

The mono channel generator/encoder 305 can then in some embodiments encode the generated mono channel audio signal using any suitable encoding format. For example in some embodiments the mono channel audio signal can be encoded using an Enhanced Voice Service (EVS) mono channel encoded form, which may contain a bit stream interoperable version of the Adaptive Multi-Rate-Wide Band (AMR-WB) codec.

The operation of encoding the mono channel is shown in FIG. 7 by step 557.

The encoded mono channel signal can then be output. In some embodiments the encoded mono channel signal is output to a multiplexer to be combined with the output of the quantizer optimiser 205 to form a single stream or output. In some embodiments the encoded mono channel signal is output separately from the quantizer optimiser 205.

In some embodiments the encoder 104 comprises a quantizer optimiser 205. The quantizer optimiser 205 can be configured to receive the stereo (difference) parameters determined by the channel analyser 203. The quantizer optimiser 205 can then in some embodiments be configured to perform a quantization on the parameters and furthermore encode the parameters so that they can be output (either to be stored on the apparatus or passed to a further apparatus).

The operation of quantizing and encoding the quantized stereo parameters is shown in FIG. 6 by step 505.

Figure 5:
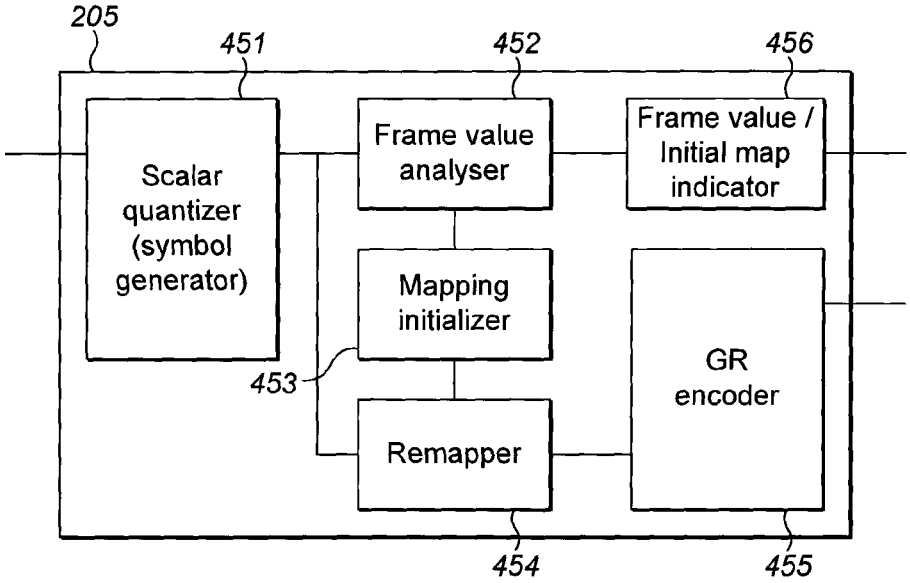
FIG. 5 shows schematically a stereo channel encoder as shown in FIG. 3 in further detail according to some embodiments.

With respect to FIG. 5 an example quantizer optimiser 205 is shown in further detail. Furthermore with respect to FIG. 8 the operation of the quantizer optimiser 205 according to some embodiments is shown.

In some embodiments the quantizer optimiser 205 comprises a scalar quantizer 451. The scalar quantizer 451 is configured to receive the stereo parameters from the channel analyser 203.

The number of level differences to be encoded in some embodiments depends on the signal bandwidth (for example 2×12(WB), 2×15(SWB), 2×17(FB)).

The operation of receiving the stereo parameters is shown in FIG. 8 by step 701.

The scalar quantizer can be configured to perform a scalar quantization on these values.

The delay values can in some embodiments be encoded with 7 2-dimensional codebooks, each having maximum 32 codevectors. The bitrate for the binaural extension can be in principle anything between 0 and 7.0 kbps. Where embodiments have a binaural extension of 0 kbps the mono version of the signal is decoded. In some embodiments the extension bitrate is automatically divided between the delays and the levels, at constant ratio (e.g. 1/3 for delays, 2/3 for levels).

In the following explanations the level encoding or quantization is described, however it would be understood that in some embodiments the following can be easily extended to cover the delay encoding or quantizing.

Furthermore it would be understood that in some embodiments there are two modes in the binaural extension: real binaural and near-far stereo. The near-far stereo mode corresponds to the case when a channel is dominant and it usually has speech material while the second channel is mainly ambient sound. In such circumstances the frames which are in near-far stereo mode have all or almost all level differences values of the same sign.

For example the scalar quantizer 451 can be configured to quantize the values with quantisation partition regions defined by the following array.

$$Q=\{-10000.0, -8.0, -5.0, -3.0, -1.0, 1.0, 3.0, 5.0, 8.0, 100000.0\}$$

The scalar quantizer 451 can thus output an index value symbol associated with the region within the quantization partition region the level difference value occurs within. For example an initial quantisation index value output can be as follows:

| | Input difference range | | | | | | | | |
|---|---|---|---|---|---|---|---|---|---|
| | −100000.0 −8.0 | −8.0 −5.0 | −5.0 −3.0 | −3.0 −1.0 | −1.0 1.0 | 1.0 3.0 | 3.0 5.0 | 5.0 8.0 | 8.0 100000 |
| Output index | 0 | 1 | 2 | 3 | 4 | 5 | 6 | 7 | 8 |

The index values can in some embodiments be output to a Frame value analyser 452 and a remapper 454.

The operation of quantizing the difference or stereo parameters to generate index values or symbols is shown in FIG. 8 by step 703.

In some embodiments the quantizer optimiser 205 comprises a frame value analyser 452. The frame value analyser 452 can in some embodiments be configured to receive the output of the scalar quantizer 451, in other words an index value associated with the quantisation partition region within which the stereo or difference parameter is found and determine whether a known pattern or subset of the symbols only is within the frame.

For example as described herein when a near-far stereo signal is being encoded (where there is a dominant channel) the frames have all or almost all level differences with the same sign.

Thus in some embodiments the frame value analyser 452 can check or analyse the frame information to determine whether or not the frame is all positive, all negative, almost all positive, or almost all negative.

In some embodiments the frame value analyser 452 can determine an almost all result analysis where the values within a frame are significantly biased in either the positive or negative sign. For example by scoring the difference between occurrences of positive and negative values and recording a significantly large magnitude value.

In some embodiments the frame value analyser 452 can be configured to output to the mapping initialiser 453 the results of the analysis. Furthermore in some embodiments the frame value analyser 452 can be configured to output to a frame value/initial map indicator 456 the same results.

For example in some embodiments the frame value analyser can pass to the mapping initialiser 453 and the frame value/initial map indicator 456 indications whether or not all of the frame is all positive, mostly positive, mostly negative or all negative.

Although in the following examples the analysis is one of 'sign' determination for an initial frame it would be understood that in some embodiments other types of trends may be determined from the analysis, for example trends of low magnitude differences or high magnitude differences.

In other words the frame value analyser 452 can be configured to determine whether the frame symbols are (or obey) a trend. The trend can be predetermined or in some embodiments inferred from the data.

The operation of analysing the symbols/parameters to determine the trend is shown in FIG. 8 by step 705.

In some embodiments the quantifier optimiser 205 comprises a mapping initialiser 453. The mapping initialiser 453 is configured in some embodiments to receive from the frame value analyser 452 an indication that the frame values follow a trend (for example all positive, almost all positive, almost all negative, or all negative). In such embodiments the mapping initialiser 453 can output an initial mapping for the mapping of the scalar quantized symbol values.

For example in some embodiments where the mapping initialiser 453 receives an indication that the frame is all positive an initial mapping can be:

| | Index Input | | | | | | | | |
|---|---|---|---|---|---|---|---|---|---|
| | 0 | 1 | 2 | 3 | 4 | 5 | 6 | 7 | 8 |
| Mapped Output | (8) | (7) | (6) | (5) | 0 | 1 | 2 | 3 | 4 |

In some embodiments where the mapping initialiser 453 receives an indication that the frame is all negative an initial mapping can be:

| | Index Input | | | | | | | | |
|---|---|---|---|---|---|---|---|---|---|
| | 0 | 1 | 2 | 3 | 4 | 5 | 6 | 7 | 8 |
| Mapped Output | 4 | 3 | 2 | 1 | 0 | (5) | (6) | (7) | (8) |

In some embodiments the symbols between the parentheses need not be taken into account, because they do not appear, therefore there are only 5 distinct symbol values to be encoded. These embodiments can be implemented depending on how the mapping analyser performs. For example, in some cases where all the values are negative/positive except very few that are not necessarily the closest to the origin. Then in such cases the values in the parenthesis can be used and the fact that they occur very rarely will be penalized through their long code length without affecting the other symbols coding. In some embodiments where it is certain that all the symbols are negative/positive then the values in the parenthesis should not be used because the processing complexity and memory are unnecessarily increased.

Where the mapping initialiser 453 receives an indication that the frame has almost all quantized levels which are positive (all quantized levels are larger or equal to −1) then the initial mapping can be:

| | Index Input | | | | | | | | |
|---|---|---|---|---|---|---|---|---|---|
| | 0 | 1 | 2 | 3 | 4 | 5 | 6 | 7 | 8 |
| Mapped Output | (8) | (7) | (6) | 2 | 0 | 1 | 3 | 4 | 5 |

Similarly where the mapping initialiser 453 receives an indication that the frame has almost all quantized levels which are negative (all quantized levels are smaller than or equal to 1) then the initial mapping can be:

| | Index Input | | | | | | | | |
|---|---|---|---|---|---|---|---|---|---|
| | 0 | 1 | 2 | 3 | 4 | 5 | 6 | 7 | 8 |
| Mapped Output | 5 | 4 | 3 | 1 | 0 | 2 | (6) | (7) | (8) |

In these two cases there are only 6 distinct symbol values to be encoded.

The mapping initialiser 453 can pass the initial mapping to the remapper 454 for further adaptation.

The operation of generating an initial map based on the analysis is shown in FIG. 8 by step 707.

In some embodiments the quantised optimiser 205 comprises a frame value/initial map indicator 456. The frame value/initial map indicator 456 can be configured to receive from the frame value analyser 452 in some embodiments the indication of the output analysis which can be used by the mapping initialiser 453 to determine the initial mapping. The frame value/initial map indicator 456 can then generate signal mapping for the frame to be passed to the decoder.

For example in some embodiments using the above four trends for the near-far mode (all positive, almost all positive, almost all negative, and all negative) the frame value/initial map indicator 456 can be configured to generate a mode bit and two signal bits (an 'all' bit and a 'sign' bit) defining for the mode which initial mapping has been used.

The setting of the signaling bits can for example be shown as an example summary.

1. If near-far mode
1.1. Set mode bit
1.2. Check if all positive
  1.2.1. Use all positive initial map
  1.2.2. Set "all" bit to 1
  1.2.3. Set sign bit to 0
  1.2.4. Return
1.3. Check if all negative
  1.3.1. Use all negative initial map
  1.3.2. Set "all" bit to 1
  1.3.3. Set sign bit to 1
1.4. Return
1.5. If most of all positive
  1.5.1. Use relaxed almost all positive initial map
  1.5.2. Set "all" bit to 0
  1.5.3. Set sign bit to 0
  1.5.4. Return
1.6. Else
  1.6.1. Use relaxed almost all negative initial map
  1.6.2. Set "all" bit to 0
  1.6.3. Set sign bit to 1
1.7. Return
2. Else
2.1. Set mode bit
2.2. Use generic initial mapping The signaling can for example for the above example be done thus by at least one bit and 3 bits at most.

The operation of setting the initial map/analysis indicator is shown in FIG. 8 by step 709.

In some embodiments the quantizer optimiser 205 comprises a remapper 454. The remapper 454 can in some embodiments be configured to receive the output of the scalar quantizer 451, in other words an index value associated with the quantization partition region within which the stereo or difference parameter is found and then the map the index values for each frame according to the occurrence frequency of the index values but using the initial map from the mapping initialiser 453.

In some embodiments the remapper 454 can perform the roles of the frame value analyser 452 and the mapping initialiser 453 to generate the initial map. In the following embodiments the initial mapping is applied prior to entering the adapt_GR function shown hereafter, where it is further altered by the reordering based on count values. In some embodiments the adapt_GR function can apply the initial mapping to replace the trivial initial 1:1 mapping shown in the function herein.

The remapper 454 can for example for each frame analyse each sub-band quantized difference value and perform a reordering of the index values after each analysis.

For example the remapper 454 can be represented by the following C code.

```
short                          /* (o) number of bits */
adapt_GR(    short * in,          /* (i) integer sequence to be encoded */
             short len,           /* (i) sequence length */
             short m,             /* (i) Golomb Rice parameter to be used
    at encoding */
             short no_symb,       /* (i) maximum number of symbols */
             short max_bits,      /* (i) maximum number of bits */
             short * qlen)        /* (o) index up to which the lower
    frequencies levels are            not encoded */
{
    short   map[NO_SYMB_LEVEL], idx[NO_SYMB_LEVEL];
    short nbits, i, j, symb, map_symb, tmp_int;
    float count[NO_SYMB_LEVEL], trmp;
    set_f(count,1,no_symb);
    /* init map */
    for(i=0;i<no_symb;i++)
    {
            map[i] = i;
            idx[i] = i;
    }
    nbits = 0;
        /* the symbols are read from the end, because the most
        relevant level values are for higher frequencies; if there
        are not enough bits, the levels corresponding to lower
        frequencies will be ignored*/
    for(i=len-1;i>0;i--)
    {
            symb = in[i];
            /* map keeps the order of the symbols */
            map_symb = map[symb];
                    /* count number of bits to GR encode with
                parameter m, encoding is done in mapped domain
                */
            nbits += ((map_symb)>>m) + m + 1;
            if (nbits<max_bits)
            {
                /* weight down the influence of the past */
                for(j=0;j<no_symb;j++)
                {
                        count[j] *= 0.9f;
                }
                                /* update count of symbols */
                count[map_symb] = count[map_symb]+1;
                j = map_symb;
                /* here the adaptation of the symbol order is done*/
                /* sort decreasing */
                while ((j>0) && (count [j]>count [j-1]))
                {
                        /* bubble j and j-1 */
                        tmp = count [j];
                        count [j] = count [j-1];
                        count [j-1] = tmp;
                        tmp_int = idx[j];
                        idx[j] = idx[j-1];
                        idx[j-1] = tmp_int;
                        j--;
                }
                /* map update based on the new order */
                for(j=0;j<no_symb;j++)
                {
                        map[idx[j]] = j;
                }
            }
            else
            {
                /* not enough bits */
                nbits -= ((map_symb)>>m) + m + 1;
                break;
            }
    }
    *qlen = i;
    return nbits;
}
```

The section labelled *init map* (or initial mapping) following the variable definition section generates an initial mapping where the symbols or quantizer index outputs i=0 to i=no_symb−1 (in other words the number of different quantizer index values, which for the example shown above is 9 {0,1, . . . 7,8}).

The section following the initial mapping, the remapping section, shows that the index values or symbols are read from the higher frequency sub-bands to the lower frequency sub-bands and are remapped according to the count value of the symbol within the frame. The count value is determined within the example shown herein by maintaining a running count of the symbol or index values, where the influence of the 'past' symbols is weighted downwards by a 0.9 recurrence factor.

The recurrence factor, the count increment factor, and the remapping or reordering can vary according to some embodiments. For example the recurrence factor in some embodiments can be a value less than 0.9 to give less weighting to past index or symbol values. For example, in other embodiments, the recurrence factor can have different values for different past encoded symbols, i.e. 0.9 for the previously encoded symbol and 0.8 for the second previous symbol encoded and so on. For example in some embodiments reordering can be made where symbols with same Count value are given. Furthermore in some embodiments in the situation or case of equal Count values, the lower valued symbols are ordered or mapped to get the position with smaller code length, or vice versa where it is known from the context that the probability of high valued symbols is higher.

The output of the remapper 454, which orders the index values or symbols according to their occurrence within the frame across the sub bands or windows is then output to the encoder.

In the examples described herein the encoder performs remapping as encoding occurs. In some embodiments each frame is analysed and the frequency or distribution of the symbols once the whole frame is analysed is used to determine the remapping of symbols.

The operation of remapping the index values or symbols according to frequency is shown in FIG. 8 by step 711.

The quantizer optimiser 205 can in some embodiments comprises a Golomb-Rice encoder 455. The Golomb-Rice encoder (GR encoder) 455 is configured to receive the remapped index values or symbols generated by the remapper and encode the index values according to the Golomb-rice encoding method. The Golomb-Rice encoder 455 in such embodiments therefore outputs a codeword representing the current and previous index values.

An example of a Golomb-Rice integer code (with GR parameter equal to 0) is one where the output is as follows.

| | Input | | | | | | | | |
|---|---|---|---|---|---|---|---|---|---|
| | 0 | 1 | 2 | 3 | 4 | 5 | 6 | 7 | 8 |
| Output | 0 | 10 | 110 | 1110 | 11110 | 111110 | 1111110 | 11111110 | 111111110 |

It would be understood that in some embodiments the Golomb-Rice integer code with parameter other than 0, or more than one parameter can be used to encode the index values. Furthermore it would be understood that any suitable entropy or integer encoding can be used in place of the GR integer code which has been for example described herein.

The operation of generating codewords according to the Golomb-Rice coding system is shown in FIG. 8 by step 713.

The GR encoder 455 can then output the stereo codewords. In some embodiments the codewords are passed to a multiplexer to be mixed with the encoded mono channel audio signal. However in some embodiments the stereo codewords can in some embodiments be passed to be stored or passed to further apparatus as a separate stream.

The operation of outputting stereo codewords and the initial map indicator are shown in FIG. 8 by step 715.

In some embodiments the encoder comprises a signal output 207. The signal output as shown in FIG. 3 represents an output configured to pass the encoded stereo parameters to be stored or transmitted to a further apparatus.

The outputting of the encoded stereo parameters is shown in FIG. 6 by step 507.

Thus in summary the embodiments described with respect to the quantizer optimiser is as follow Receive difference values Quantize difference values to generate symbols representing quantization map region (in other words generate array of symbols to encode, x, x[i]\in [0,N−1], i=1:M)

Analyze difference values/symbols to determine whether they are a trend/defined sub-group of the total number of symbols Generate initial mapping from symbols (index values) based on the analysis for example determining that the symbols are all positive and therefore generating a first mapping such that the difference values equal to or greater than zero are given the smaller GR codes Generate initial count Count[j]=1, j=0:N−1 (initial array of counts for each symbol)

For each symbol (For i=0:length(x)−1)

Encode x[i]

Update Count with:

i. Count[j]=0.9*Count[j], j=0:N−1, (weighting of the past)

ii. Count[x[i]]=Count[x[i]]+1;

Reorder the symbols based on the frequency of occurrence, such that the most frequent is on the first position (will be encoded with GR code for 0)

End for

In order to fully show the operations of the codec FIGS. 9 and 10 show a decoder and the operation of the decoder according to some embodiments.

In some embodiments the decoder 108 comprises a mono channel decoder 801. The mono channel decoder 801 is configured in some embodiments to receive the encoded mono channel signal.

The operation of receiving the encoded mono channel audio signal is shown in FIG. 10 by step 901.

Furthermore the mono channel decoder 801 can be configured to decode the encoded mono channel audio signal using the inverse process to the mono channel coder shown in the encoder.

The operation of decoding the mono channel is shown in FIG. 10 by step 903.

In some embodiments the mono channel decoder 801 can be configured to output the mono channel audio signal to the stereo channel generator 809.

In some embodiments the decoder 108 can comprise a stereo channel decoder 803. The stereo channel decoder 803 is configured to receive the encoded stereo parameters and the initial mapping indicator. These can be passed to the symbol initial order determiner 806.

The operation of receiving the encoded stereo parameters and the initial mapping indicator is shown in FIG. 10 by step 902.

Furthermore the stereo channel decoder 803 can be configured to decode the stereo channel signal parameters from the entropy code. For example the reverse of the example code can be used as shown herein so that

| | Output | | | | | | | | |
|---|---|---|---|---|---|---|---|---|---|
| | 0 | 1 | 2 | 3 | 4 | 5 | 6 | 7 | 8 |
| Input | 0 | 10 | 110 | 1110 | 11110 | 111110 | 1111110 | 11111110 | 111111110 |

The operation of decoding the stereo parameters is shown in FIG. 10 by step 904.

In some embodiments the decoder 108 can comprise a symbol initial order determiner 806. The symbol initial order determiner can be configured to, based on the initial map indicator, generate an initial mapping and from the initial mapping converting the symbol values into initial de-mapped symbols.

Thus, for example when the initial mapping indicator determine that the frame is all positive an initial de-mapping can be:

| | Remapped Output | | | | | | | | |
|---|---|---|---|---|---|---|---|---|---|
| | 0 | 1 | 2 | 3 | 4 | 5 | 6 | 7 | 8 |
| Input | (8) | (7) | (6) | (5) | 0 | 1 | 2 | 3 | 4 |

The operation of generating an initial de-mapping is shown in FIG. 10 by step 905.

The symbol initial order determiner 806 is further configured, in some embodiments, to output the decoded index values to a symbol reorderer 807.

In some embodiments the decoder comprises a symbol count updater 805. The symbol count updater 805 can be configured to receive the current frame stereo channel index values (decoded and reordered symbols) and maintain a count of the reordered (remapped) values using the same count process as used in the encoder. In other words the symbol count updater 805 is configured to update a counter based on the symbols currently decoded within a frame. The symbol count updater 805 is configured to reset the count for each count so that the reordering/remapping is done for each frame.

The (symbol) index count or frequency order can be output to the symbol reorderer 807.

In some embodiments the decoder 108 comprises a symbol reorderer 807. The symbol or index reorderer (demapper) in some embodiments is configured to receive the symbol count updater output (in other words the index/symbol count frequency) and reorder the decoded symbols received from the stereo channel decoder 803 according to the symbol frequency. In other words the symbol reorderer 807 is configured to re-order the index values to the original order output by the scaler quantizer. Furthermore in some embodiments the symbol reorderer 807 is configured to de-quantize the remapped or re-ordered index value into a parameter (such as the interaural time difference/correlation value; and interaural level difference/energy difference value) using the inverse process to that defined within the quantizer section of the quantizer optimiser within the encoder.

The operation of re-ordering and dequantizing the decoded symbols to generate dequantized (regenerated) stereo parameters for each frame is shown in FIG. 10 by step 906.

The symbol count updater 805 can receive the re-ordered symbol and update the count. The symbol count data can be output to the symbol reorderer 807 for the next symbol re-ordering.

The updating of the symbol (index) count within the frame is shown in FIG. 10 by step 907.

The symbol reorderer 807 can furthermore output the reordered index value to the stereo channel generator.

The outputting of the stereo parameters to the stereo channel generator is shown in FIG. 10 by step 908.

In some embodiments the decoder comprises a stereo channel generator 809 configured to receive the reordered decoded symbols (the stereo parameters) and the decoded mono channel and regenerate the stereo channels in other words applying the level differences to the mono channel to generate a second channel.

The operation of generating the stereo channels from the mono channel stereo parameters is shown in FIG. 10 by step 909.

Figure 11:
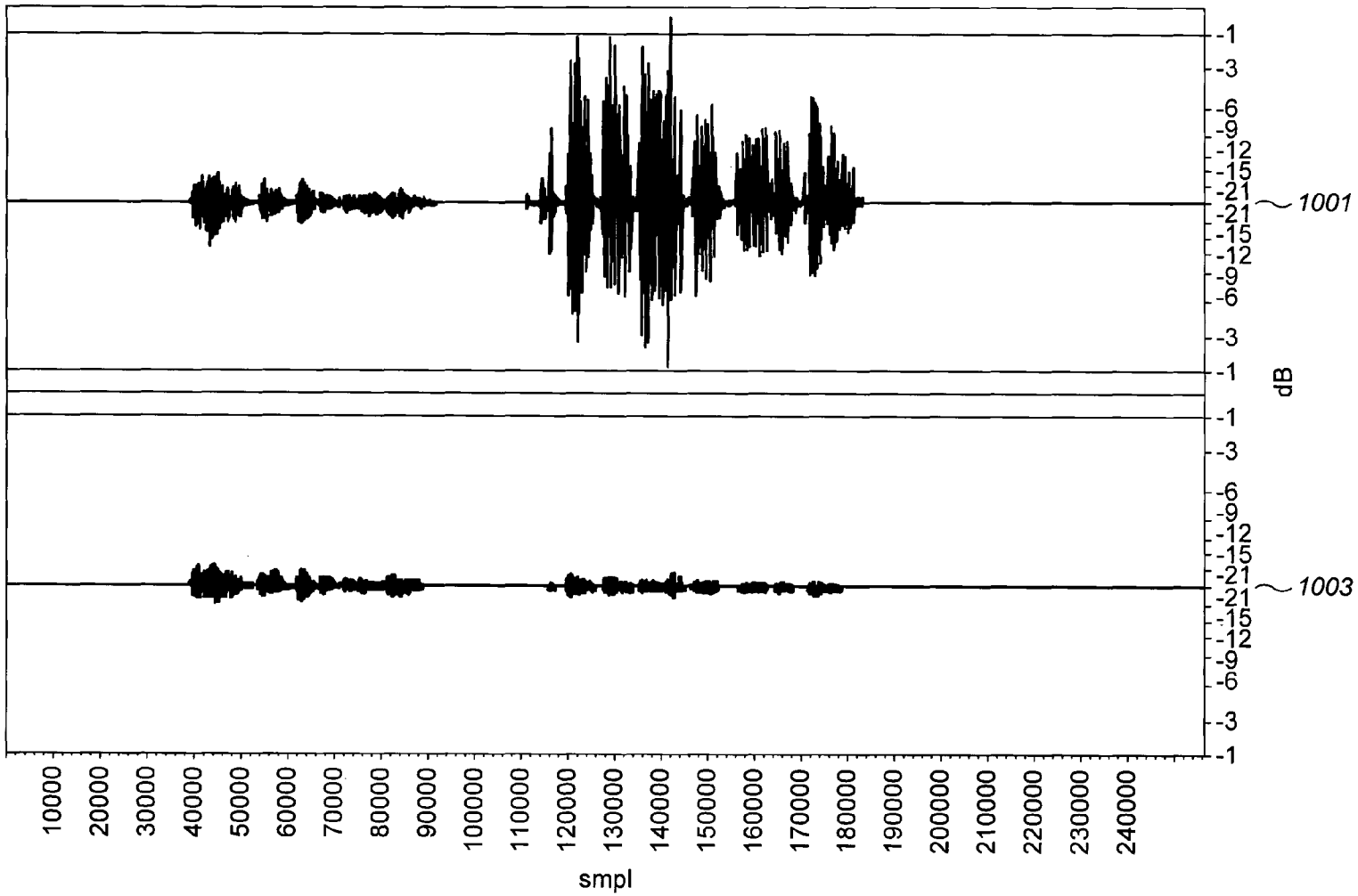
FIGS. 11 to 13 show example channel signals, encoded channel and encoded channel audio signals using embodiments.
Figure 12:
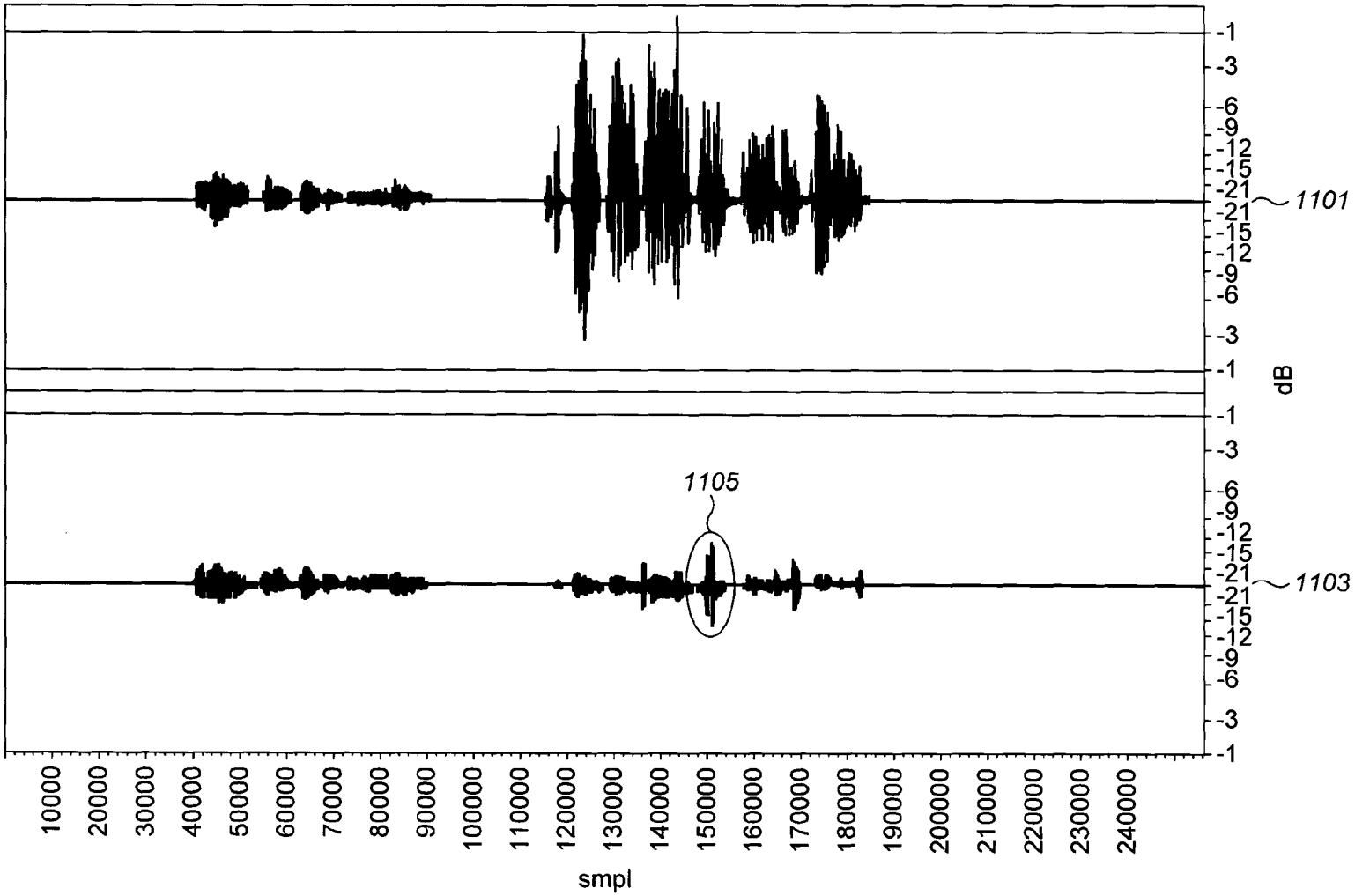
Figure 13:
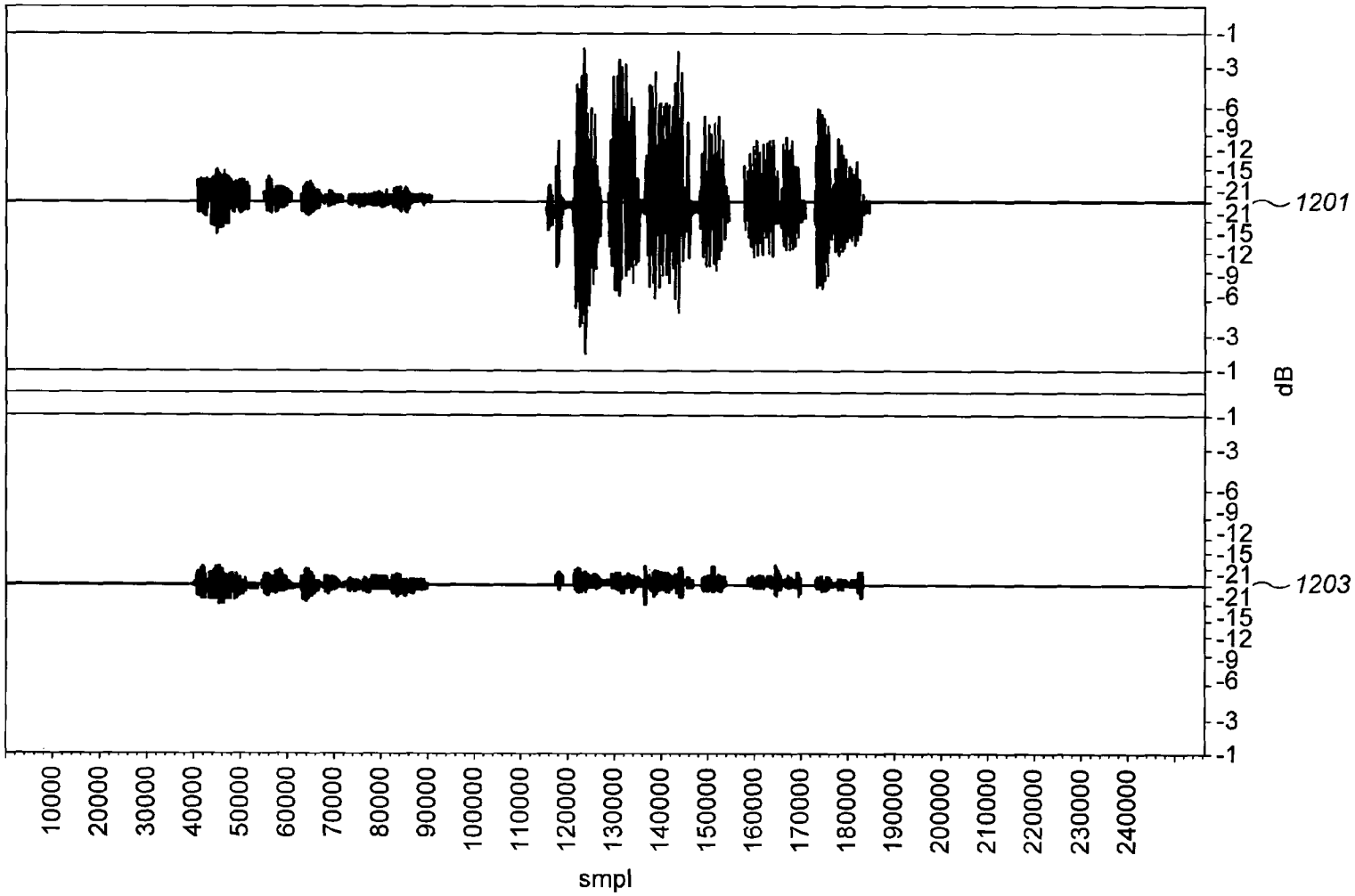

With respect to FIGS. 11, 12, and 13 an example two channel audio signal is shown in original form, in conventional encoded form and encoded according to embodiments form.

FIG. 11 for example shows that the second part of audio trace shows an example near-far stereo candidate where the upper channel 1001 is clearly dominant over the lower channel 1003.

FIG. 12 shows the audio signals from FIG. 11 encoded using a 32 kbps core and a 4.5 kps binaural extension, and decoded using a conventional binaural encoding system where an error in the encoding/decoding process produces an audible lower channel 1103 glitch 1105 due to the coding tracking error.

FIG. 13 shows the audio signals from FIG. 11 encoded using a 32 kbps core and a 4.5 kps binaural extension, and decoded using some embodiments as described above. FIG. 13 shows the lower channel 1203 which is much closer to the lower channel 1003 of FIG. 11.

Although the above examples describe embodiments of the application operating within a codec within an apparatus 10, it would be appreciated that the invention as described below may be implemented as part of any audio (or speech) codec, including any variable rate/adaptive rate audio (or speech) codec. Thus, for example, embodiments of the application may be implemented in an audio codec which may implement audio coding over fixed or wired communication paths.

Thus user equipment may comprise an audio codec such as those described in embodiments of the application above.

It shall be appreciated that the term user equipment is intended to cover any suitable type of wireless user equipment, such as mobile telephones, portable data processing devices or portable web browsers.

Furthermore elements of a public land mobile network (PLMN) may also comprise audio codecs as described above.

In general, the various embodiments of the application may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the application may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this application may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the application may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

As used in this application, the term 'circuitry' refers to all of the following:

(a) hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

The invention claimed is:

1. A method for execution by an audio encoder comprising at least one processor coupled to at least one memory including computer code for one or more programs, wherein the method comprises:

determining at least one set of parameters defining a difference between at least two audio signal channels;

scalar quantizing the at least one set of parameters as symbols;

analysing the symbols of the at least one set of scalar quantized parameters to determine trend;

mapping the symbols of the at least one set of scalar quantized parameters according to a first mapping to generate mapped symbols with an associated symbol order position based on the trend; and encoding the mapped symbols based on the order position of the mapped symbols.

2. The method as claimed in claim 1, further comprising:

determining at least one subsequent scalar quantized parameter symbol;

mapping the subsequent scalar quantized parameter symbol dependent on a frequency distribution of mapped symbols and the first mapping to generate a remapped symbol with an associated symbol order position; and encoding the remapped symbol based on an order position of the remapped symbol.

3. The method as claimed in claim 2, wherein the frequency distribution of mapped symbols is determined by:

maintaining a count of a number of mapped symbols for each mapped symbol of a group of mapped symbols.

4. The method as claimed in claim 1, wherein the at least one set of parameters comprises at least one of:

an interaural time difference; and an interaural level difference.

5. The method as claimed in claim 1, wherein analysing symbols of the at least one set of scalar quantized parameters to determine a trend comprises determining at least one of:

all of the at least one set of parameters have positive values;

all of the at least one set of parameters have negative values;

most of the at least one set of parameters have positive values;

most of the at least one set of parameters have negative values;

all of the at least one set of parameters have lower magnitude values;

all of the at least one set of parameters have higher magnitude values; and all of the at least one set of parameters have range defined magnitude values.

6. The method as claimed in claim 1, wherein mapping the symbols of the at least one set of scalar quantized parameters according to a first mapping to generate mapped symbols with associated order position symbols based on the trend comprises generating an initial mapping wherein symbols of the at least one set of scalar quantized parameters which conform to the trend have symbols which have an associated order position symbol lower than symbols of at least one set of scalar quantized parameters which do not conform to the trend.

7. The method as claimed in claim 1, wherein encoding the mapped symbols dependent on an order position of the mapped symbols comprises applying a Golomb-Rice encoding to the mapped symbols dependent on the mapped symbols order position.

8. A method for execution by an audio decoder comprising at least one processor coupled to at least one memory including computer code for one or more programs, wherein the method comprises:

decoding from a first part of a signal a scalar quantized parameter symbol and from a second part a parameter trend indicator;

mapping the scalar quantized parameter symbol dependent on the parameter trend indicator to generate a demapped scalar quantized parameter symbol, wherein the mapping is dependent on the parameter trend indicator;

decoding from the first part of a signal a further scalar quantized parameter symbol using a Golomb-Rice decoding; and mapping the further scalar quantized parameter symbol dependent on a frequency distribution of demapped scalar quantized parameter symbols.

9. The method as claimed in claim 8, further comprising:

determining the frequency distribution of demapped scalar quantized parameter symbols by maintaining a count of the demapped scalar quantized parameter symbols for a group of the demapped scalar quantized parameter symbols.

10. The method as claimed in claim 8, wherein mapping the scalar quantized parameter symbol comprises:

determining an inverse mapping dependent on a decreasing occurrence order mapping for the frequency distribution of demapped scalar quantized parameter symbols; and applying the inverse mapping.

11. An apparatus of an audio encoder and comprising at least one processor and at least one memory including computer code for one or more programs, the at least one memory and the computer code configured to with the at least one processor cause the apparatus to at least:

determine at least one set of parameters defining a difference between at least two audio signal channels;

scalar quantizing the at least one set of parameters as symbols;

analyse the symbols of the at least one set of scalar quantized parameters to determine a trend;

map the symbols of the at least one set of scalar quantized parameters according to a first mapping to generate mapped symbols with an associated symbol order position based on the trend; and encode the mapped symbols based on the order position of the mapped symbols.

12. The apparatus as claimed in claim 11, further caused to:

determine at least one subsequent scalar quantized parameter symbol;

map the subsequent scalar quantized parameter symbol dependent on a frequency distribution of mapped symbols and the first mapping to generate a remapped symbol with an associated symbol order position; and encode the remapped symbol based on an order position of the remapped symbol.

13. The apparatus as claimed in claim 12, wherein the apparatus further caused to determine the frequency distribution of mapped symbols by being caused to:

maintain a count of a number of mapped symbols for each mapped symbol of a group of mapped symbols.

14. The apparatus as claimed in claim 11, wherein the at least one set of parameters comprises at least one of:

an interaural time difference; and an interaural level difference.

15. The apparatus as claimed in claim 11, wherein the apparatus caused to analyse symbols of the at least one set of scalar quantized parameters to determine a trend is caused to determine at least one of:

all of the at least one set of parameters have positive values;

all of the at least one set of parameters have negative values;

most of the at least one set of parameters have positive values;

most of the at least one set of parameters have negative values;

all of the at least one set of parameters have lower magnitude values;

all of the at least one set of parameters have higher magnitude values; and all of the at least one set of parameters have range defined magnitude values.

16. The apparatus as claimed in claim 11, wherein the apparatus caused to map the symbols of the at least one set of scalar quantized parameters according to a first mapping to generate mapped symbols with associated order position symbols based on the trend is caused to generate an initial mapping wherein symbols of the at least one set of scalar quantized parameters which conform to the trend have symbols which have an associated order position symbol lower than symbols of at least one set of scalar quantized parameters which do not conform to the trend.

17. The apparatus as claimed in claim 11, wherein the apparatus caused to encode the mapped symbols dependent on an order position of the mapped symbols is further caused to apply a Golomb-Rice encoding to the mapped symbols dependent on the mapped symbols order position.

18. An apparatus of an audio decoder and comprising at least one processor and at least one memory including computer code for one or more programs, the at least one memory and the computer code configured to with the at least one processor cause the apparatus to at least:

decode from a first part of a signal a scalar quantized parameter symbol and from a second part a parameter trend indicator;

map the scalar quantized parameter symbol dependent on the parameter trend indicator to generate a demapped scalar quantized parameter symbol, wherein the mapping is dependent on the parameter trend indicator;

decode from the first part of a signal a further scalar quantized parameter symbol using a Golomb-Rice decoding; and map the further scalar quantized parameter symbol dependent on a frequency distribution of demapped scalar quantized parameter symbols.

19. The apparatus as claimed in claim 18, further caused to determine the frequency distribution of demapped scalar quantized parameter symbols by being caused to maintain a count of the demapped parameter symbols for a group of the demapped scalar quantized parameter symbols.

20. The apparatus as claimed in claim 18, wherein the apparatus caused to map the scalar quantized parameter symbol is further caused to:

determine an inverse mapping dependent on a decreasing occurrence order mapping for the frequency distribution of demapped scalar quantized parameter symbols; and apply the inverse mapping.

* * * * *